United States Patent [19]

Weller

[11] Patent Number: 4,873,000

[45] Date of Patent: Oct. 10, 1989

[54] CARPET FRESHENING AND DEODORIZING COMPOSITION

[75] Inventor: Jeanne M. Weller, Glen Rock, N.J.

[73] Assignee: Sterling Drug Inc., New York, N.Y.

[21] Appl. No.: 202,776

[22] Filed: Jun. 3, 1988

[51] Int. Cl.[4] ..... D06M 11/04; C11D 3/12

[52] U.S. Cl. ..... 252/8.6; 252/8.9

[58] Field of Search ..... 252/8.6

[56] References Cited

U.S. PATENT DOCUMENTS

| | | | |
|---|---|---|---|
| 1,775,040 | 9/1930 | Jennings | 252/174.25 |
| 2,213,641 | 9/1940 | Tainton | 252/89 |
| 3,206,408 | 9/1965 | Vitalis | 252/161 |
| 3,418,243 | 12/1968 | Hoxie | 252/154 |
| 4,161,449 | 7/1979 | Smith et al. | 252/8.6 |
| 4,304,675 | 12/1981 | Corey et al. | 252/8.6 |
| 4,395,347 | 7/1983 | McLaughlin et al. | 252/139 |
| 4,648,882 | 3/1987 | Osberghaus et al. | 8/142 |

*Primary Examiner*—A. Lionel Clingman

*Attorney, Agent, or Firm*—Frederik W. Stonner; Paul E. Dupont

[57] ABSTRACT

A powdered composition for freshening and deodorizing carpets comprising an inorganic sulfate, bicarbonate or chloride, an aluminum silicate clay, a liquid agglomerating agent, and a fragrance, and a method of use thereof comprising applying the composition uniformly to the carpet and thereafter removing it from the rug.

9 Claims, No Drawings

CARPET FRESHENING AND DEODORIZING COMPOSITION

BACKGROUND OF THE INVENTION

1. Field of the Invention

The invention relates to a composition and method for freshening and deodorizing rugs and carpets. More specifically it relates to such a composition which is clay-based and in powder form and to a method whereby the composition is applied to a rug or carpet and subsequently removed therefrom by vacuuming thereby resulting in the freshening and deodorizing of the carpet.

2. Information Disclosure Statement

Aqueous shampoo compositions for the cleaning of rugs and carpets are well known. Typically, such compositions include water and a detergent material for soil removal. One such composition, described in U.S. Pat. No. 3,206,408, comprises water, a high foaming anionic detergent and an inorganic siliceous clay, e.g., hydrous alumina silicate.

Also known for the cleaning of rugs and carpets are powdered compositions containing solvents and surfactants in combination with a carrier material which are adapted for removal from the treated rug or carpet by vacuuming. One such composition, disclosed in U.S. Pat. No. 3,418,243, comprises an inert carrier such as diatomaceous earth, a volatile organic solvent for removing oils and greases, a water-soluble surfactant and water. Another such composition, described in U.S. Pat. No. 4,395,347, comprises a primary cleaning system comprising an ether alcohol cleaning solvent and a surfactant, and a borax carrier for the cleaning system. U.S. Pat. No. 4,648,882 describes a carpet cleaning composition in the form of a dry cleaning preparation in powder form which consists essentially of a zeolite, at least one surfactant, at least one dry cleaning solvent such as benzines, alcohols, ethers or esters, at least one granulating aid such as alkali metal silicates and optionally one solid water soluble acid as neutralizer for free alkali which may be present in the zeolite as well as customary constituents of powdered dry cleaning preparations. The powdered compositions described in these three patents are distributed evenly over the rug or carpet using some form of applicator such as a sponge or a brush, allowed to dry and then removed from the carpet or rug by vacuuming.

Other powdered rug and carpet treating compositions are known which are designed primarily for freshening and deodorizing purposes although they may impart other beneficial properties to the rug or carpet. Such compositions are described, for example, in U.S. Pat. Nos. 4,161,449 and 4,304,675. The powdered carpet composition described in U.S. Pat. No. 4,161,449 comprises a blend of an inorganic salt carrier such as sulfates or bicarbonates, an agglomerating agent such as clay and a fragrance. U.S. Pat. No. 4,304,675 described a powdered carpet treating compositon consisting essentially of a blend of an inorganic salt such as sulfates or bicarbonates, a natural or synthetic zeolite as an antistatic and rheological agent, a non-fragrant liquid agglomerating agent such as diethyl phthalate or dipropylene glycol, and a deodorizing fragrance. The powdered freshening and deodorizing compositions described in these two patents are not distributed onto the carpet or rug by rubbing or brushing but are sprinkled onto the carpet or rug surface from a suitable dispensing container and, after a short period of time, are removed by vacuuming.

In addition to powdered preparations for cleaning and/or freshening and deodorizing rugs and carpets, powdered preparations designed for the removal from delicate fabrics of stains and spots caused, for example, by foods and beverages, have been employed for many years. One such preparation, described in U.S. Pat. No. 1,775,040, consists essentially of a powdery vehicle, e.g., hydrated aluminum silicate known as "pyrophyllites", and an essential oil distributed throughout the powdery vehicle. Another such preparation, described in U.S. Pat. No. 2,213,641, consists of a synthetic alumina in adsorbent form and an adsorbent, such as a synthetic zeolite or hydrous aluminum silicate, in powder form.

Although a variety of powdered rug and carpet freshening and deodorizing compositions have enjoyed or presently enjoy success in the market place, nonetheless a number of such compositions suffer from certain drawbacks and disadvantages. One drawback is that the retrieval of the composition from the rug by vacuuming is not always as efficient as it should be in which case unsightly residues of the composition on the rug surface often are perceived. Another drawback in some cases is that certain of the solid ingredients employed, for example synthetic zeolites, are quite expensive and thus contribute significantly to the cost of manufacture of the composition.

SUMMARY OF THE INVENTION

It has now been discovered that by employing a mixture of one or more selected inorganic salts with an aluminum silicate clay as the solid component of a powdered carpet freshening and deodorizing composition, the efficiency of the vacuum retrieval of the composition from the carpet is unexpectedly significantly improved, both with respect to the ease and amount of retrieval. Moreover, aluminum silicate, by virtue of occurring naturally and its ready commercial availability, is relatively inexpensive and therefore contributes significantly to lower cost of manufacture of the composition as compared to compositions which require substantially more expensive solid components such as synthetic zeolites.

Thus in one aspect, the invention resides in a powdered carpet deodorizer and freshener composition consisting essentially of:

(a) from about 57 to about 73 weight-percent of an inorganic salt selected from the group consisting of sulfates, bicarbonates and chlorides;

(b) from about 25 to about 40 weight-percent of an aluminum silicate clay derived from pyrophyllite and having a particle size distribution of about 10 about 60 microns;

(c) from about 1 to about 2 weight-percent of a liquid agglomerating agent; and (d) from about 1 to about 2 weight-percent of a fragrance.

In another aspect, the invention resides in a method for deodorizing and freshening a carpet which comprises applying to the carpet, in an amount effective to deodorize and freshen the carpet, the composition described hereinabove and thereafter removing the composition from the carpet.

In practicing the invention, in addition to deodorizing and freshening the carpet, the composition concomitantly imparts an antistatic effect thereto. Furthermore, concomitant with the vacuum retrieval of the composition from the carpet, the fragrance employed in the composition is dispersed into the immediate environment in which the carpet is located thereby imparting a pleasing odor thereto.

DETAILED DESCRIPTION OF THE INVENTION INCLUDING THE PREFERRED EMBODIMENTS

The powdered carpet deodorizing and freshening composition comprises four esential components: an inorganic salt selected from sulfates, bicarbonates and chlorides, an aluminum silicate clay, a liquid agglomerating agent, and a fragrance.

The blend of the inorganic salt and the aluminum silicate clay functions as a carrier for the fragrance and agglomerating agent as well as for any optional ingredients which may be included in the composition as described hereinbelow.

INORGANIC SALT

The inorganic salt employed in the composition is selected from sulfates, bicarbonates and chlorides, particularly the alkali metal and alkaline earth metal salts and mixtures of such salts. The inorganic salt is the major component of the composition and is employed in an amount of from about 57 to about 73 percent by weight of the composition. The inorganic salt should have a particle size distribution in the range of from about 74 to about 1200 microns.

ALUMINUM SILICATE CLAY

The aluminum silicate clay employed in the composition is derived from the mineral pyrophyllite which is a hydrous silicate of alumina corresponding to the formula $Al_2Si_4O_{10}(OH)_2$. The aluminum silicate clay is prepared from pyrophylitte by crushing and grinding to appropriate particle sizes. Such clays are commercially available. Suitable aluminum silicate clays are those sold under the registered tradename PYRAX by R. T. Vanderbilt Company, Inc., Norwalk, Connecticut, such as, for example, PYRAX B, PYRAX WA, PYRAX RG and PYRAX ABB. A preferred PYRAX is PYRAX WA because of its bright white appearance. The aluminum silicate clay should have a particle size distribution in the range of about 10 to about 60 microns. In addition to its primary function as a carrier in conjunction with the inorganic salt, the aluminum silicate clay also functions to impart an antistatic effect to the carpet. The amount of aluminum silicate clay employed is from about 25 to about 40 percent by weight of the composition.

AGGLOMERATING AGENT

A variety of liquid agglomerating agents can be employed in the composition. The agglomerating agent should be chosen however so as not to counteract or otherwise detract from the fragrance imparting property of the composition. Examples of liquid agglomerating agents which can be employed are diethyl phthalate dimethyl phthalate, various glycols, such as ethylene glycol, diethylene glycol, propylene glycol, dipropylene glycol, polyalkylene glycols, cosmetic fluids (e.g. Exxon cosmetic fluids) and various liquid surfactants, such as nonionic surfactants, e.g. Tergitols (e.g. Tergitol 15-S-9, Union Carbide Corporation) liquid Pluronics, e.g. Pluronic L-61 (BASF-Wyandotte Corp.), Pluracol W-170 (BASF-Wyandotte Corp.), quaternary ammonium compounds such as N-alkyl ($C_{18}$92%, $C_{16}$8%)-N-ethyl morpholinium ethyl sulfates and also water may be used.

The liquid agglomerating agent is used in an amount of from about 1 to about 2 percent by weight of the composition. In addition to their agglomerating effect, such agents also function as extenders for the fragrance and ensure more even release of the fragrance from the composition.

FRAGRANCE

The fragrances employed in the composition are selected from various volatile odorous agents, including essential oils, aromatic chemicals and the like. A great variety of these materials are known to those skilled in the perfuming arts and these materials may comprise, for example, one or more natural or synthetic aromatic agents or mixtures thereof. Thus, the present invention contemplates various fragrances or perfumes, such as essential oils having a floral bouquet, or a citrus, herbal or spice fragrance, etc. The amount of fragrance employed is from about 1 to about 2 percent by weight of the composition.

OPTIONAL INGREDIENTS

In addition to the essential ingredients, other agents may be employed in the composition in order to provide further beneficial effects. Such agents which may be employed are antistatic agents, antimicrobial agents, cleaning agents, (e.g. various anionic, nonionic, cationic and ampholytic detergents) as well as various fragrance volatility control agents. These materials may be used in the composition in amounts effective to accomplish their primary functions.

PREPARATION OF COMPOSITION

In preparing the blend of the aforementioned ingredients to produce the final powdered carpet treating composition, various methods may be used. Thus the dry powdered ingredients may be placed into a Munson rotary batch blender while it is operating and mixed for approximately five minutes. Preferably, the aluminum silicate clay is added first followed by the inorganic salt. Then the fragrance and agglomerating liquid may be added, generally by means of a spray nozzle, and the material mixed until uniformly blended. Preferably the liquid agglomerating agent and fragrance are added as a premix. In place of the Munson blender, a Patterson-Kelley twin shell blender or a Marion ribbon blender may be used. It is preferred to add the fragrance and liquid agglomerating agent after the dry components have been blended.

APPLICATION OF COMPOSITION

The carpet treating composition can be applied from a shakeable canister or container having a top that contains openings whereby the product may be dispensed. The hole size and the number of holes may vary and the top may have a closure that can regulate the number of holes being opened at any time. The amount of product discharged can thus be regulated by the hole openings.

The container used to dispense the material may be made of plastic material including polyethylene, polypropylene or polyacrylate or combinations thereof. The container may also be cardboard based and preferentially should be of a barrier nature i.e. aluminum foil inside and outside, or wax-coated or laminated.

The composition is sprinkled onto the carpet by shaking the container from side to side, an effective rate of application being from about 2 to 4 g per square foot. It is not necessary to completely cover the carpet. The carpet then is vacuumed using a standard vacuum cleaner.

In practicing the method of the invention, the composition also substantially reduces the static electricity in the carpet as a result of the antistatic properties possessed by the aluminum silicate clay.

The invention is further illustrated by the following example without, however, being limited thereto.

EXAMPLE

A 1000 g batch of the following formulation was prepared using the procedure described hereinbefore. A Patterson-Kelly twin shell blender was employed.

| Ingredient | Weight-Percent |
|---|---|
| Sodium Sulfate (anhydrous)[a] | 62.5 |
| Aluminum Silicate Clay[b] | 35.0 |
| Dipropylene Glycol | 1.5 |
| Fragrance | 1.0 |
| | 100.0 |

[a]Average particle size: 410 microns
[b]PYRAX WA; average particle size: 13 microns The above formulation of the invention (hereafter Formulation A) was compared for vacuum retrieval from a carpet with a commercially available formulation (hereafter Formulation B) having the following composition:

| Ingredient | Weight-Percent |
|---|---|
| Sodium Sulfate (anhydrous)[a] | 68.50 |
| Sodium Bicarbonate (#5)[b] | 26.00 |
| Zeolite ZB-100[c] | 3.00 |
| Dipropylene Glycol | 1.25 |
| Fragrance | 1.25 |
| | 100.00 |

[a]Average particle size: 410 microns
[b]The No. 5 sodium bicarbonate is a coarse granular material such that only about 20% passes through U.S. standard screen No. 100.
[c]The zeolite ZB-100 in the above formulation is the sodium form of the type A zeolite crystal structure. It is an alkaline metal aluminum silicate having a medium particle size of 3–5 microns and is such that about 4% of the composition has a particle size greater than 10 microns. This material is available from Union Carbide Corp. (See U.S. Pat. 4,304,675 at column 5).

The comparative method used for determining the amount of compositon removed from the carpet by vacuuming was as follows:

Two identical 100% nylon, medium pile carpets having dimensions of 8 feet by 10 feet were employed. Formula A was uniformly distributed onto one carpet and Formula B onto the other carpet in an amount in each case of 250 g (approx. 3 g/sq. ft.). Two identical Hoover Upright vacuum cleaners, one for each carpet, were used to retrieve the compositions from the carpets, the vacuum bag in each case being pre-weighed. Each carpet was vacuumed horizontally and vertically for the identical period of time. This procedure i.e., distribution of the composition to the carpet followed by vacuuming, was repeated five times. After the sixth treatment the vacuum bags were reweighed to determine the amount of residue removed from each carpet. The percent of residual composition recovered from each carpet was calculated using the following equation:

$$\frac{(\text{Weight of bag} + \text{residue}) - (\text{Wt. of empty bag})}{\text{Weight of total product applied to carpet}} \times 100$$

The above-described comparative test was performed three times. The results obtained were as follows:

| | Percent of Total Applied Composition Retrieved | |
|---|---|---|
| Test | Formula A | Formula B |
| 1 | 90 | 72 |
| 2 | 81 | 66 |
| 3 | 81 | 75 |
| Average: | 84 | 71 |

As can be seen from the above results, the percent of total composition applied to the carpet which was retrieved on vacuuming is significantly higher for Formulation A as compared to Formulation B. The composition of the invention when used in accordance with the method described hereinbefore, rids the carpet of troublesome odors such as derived from pets, tobacco smoke, cooking, etc. thus leaving the carpet with a fresh, clean smell. Furthermore, the fragrance which passes through the vacuum cleaner eliminates vacuum odors and, when dispelled into the room atmosphere, leaves the room smelling fresher and cleaner.

What is claimed is:

1. A powdered carpet deodorizer and freshener composition consisting essentially of:

(a) from about 57 to about 73 weight-percent of an inorganic salt selected from the group consisting of alkali metal and alkaline earth metal sulfates, bicarbonates and chlorides;

(b) from about 25 to about 40 weight-percent of an aluminum silicate clay derived from pyrophyllite and having a particle size distribution of from about 10 to about 60, microns;

(c) from about 1 to about 2 weight-percent of a liquid agglomerating agent; and (d) from about 1 to about 2 weight-percent of a fragrance.

2. The composition of claim 1 wherein the inorganic salt is an alkali metal salt.

3. The composition of claim 2 wherein the inorganic salt is an alkali metal sulfate.

4. The composition of claim 1 consisting essentially of:

(a) 62.5 percent by weight of sodium sulfate;

(b) 35.0 percent by weight of an aluminum silicate clay;

(c) 1.5 percent by weight of dipropylene glycol; and (d) 1.0 percent by weight of a fragrance.

5. A method for deodorizing and refreshing a carpet which comprises applying to the carpet, in an amount effective to deodorize and freshen the carpet, a powdered carpet deodorizer and freshener composition consisting essentially of:

(a) from about 57 to about 73 weight-percent of an inorganic salt selected from the group consisting of alkali metal and alkaline earth metal sulfates, bicarbonates and chlorides;

(b) from about 25 to about 40 weight-percent of an aluminum silicate clay derived from pyrophyllite and having a particle size distribution of from about 10 to about 60 microns;

(c) from about 1 to about 2 weight-percent of a liquid agglomerating agent; and (d) from about 1 to about 2 weight-percent of a fragrance; and thereafter removing the composition from the carpet.

6. The method according to claim 5 wherein the inorganic salt is an alkali metal salt.

7. The method according to claim 6 wherein the inorganic salt is an alkali metal salt.

8. The method according to claim 7 wherein the composition consists essentially of:

(a) 62.5 percent by weight of sodium sulfate;

(b) 35.0 percent by weight of an aluminum silicate clay;

(c) 1.5 percent by weight of dipropylene glycol; and (d) 1.0 percent by weight of a fragrance.

9. The method according to claim 5 wherein the composition is applied to the carpet at a rate of from about 2 to about 4 grams per square foot.

* * * * *

UNITED STATES PATENT AND TRADEMARK OFFICE

CERTIFICATE OF CORRECTION

PATENT NO. : 4,873,000

DATED : October 10, 1989

INVENTOR(S) : Jeanne M. Weller

It is certified that error appears in the above-identified patent and that said Letters Patent is hereby corrected as shown below:

Column 1, line 58, "described" should read --describes--.

Column 7, line 11, Claim 7, "salt", second occurrence, should read --sulfate--.

Signed and Sealed this

Twenty-second Day of January, 1991

*Attest:*

HARRY F. MANBECK, JR.

*Attesting Officer*

*Commissioner of Patents and Trademarks*